United States Patent [19]

de Nora

[11] Patent Number: 4,767,519

[45] Date of Patent: Aug. 30, 1988

[54] MONOPOLAR AND BIPOLAR ELECTROLYZER AND ELECTRODIC STRUCTURES THEREOF

[75] Inventor: Oronzio de Nora, Milan, Italy

[73] Assignee: Oronzio de Nora Impianti Elettrochimici, Milan, Italy

[21] Appl. No.: 10,889

[22] PCT Filed: Mar. 7, 1986

[86] PCT No.: PCT/EP86/00120

§ 371 Date: Oct. 17, 1986

§ 102(e) Date: Oct. 17, 1986

[87] PCT Pub. No.: WO86/05216

PCT Pub. Date: Sep. 12, 1986

[30] Foreign Application Priority Data

Mar. 7, 1985 [IT] Italy ..... 19798 A/85

[51] Int. Cl.[4] ..... C25B 9/00; C25B 11/03; C25B 15/08

[52] U.S. Cl. ..... 204/255; 204/263; 204/279; 204/284; 204/289; 204/290 R; 204/290 F; 204/257

[58] Field of Search ..... 204/253–258, 204/263–266, 279, 286–289, 290 R, 284, 290 F

[56] References Cited

U.S. PATENT DOCUMENTS 3,980,545 9/1976 Lachaux et al. ..... 204/286
4,402,809 9/1983 Dilmore ..... 204/255 X
4,440,615 4/1984 Perei ..... 204/253
4,464,242 8/1984 Boulton ..... 204/288 X
4,581,114 4/1986 Morris et al. ..... 204/254 X

FOREIGN PATENT DOCUMENTS 0111149 6/1984 European Pat. Off. .
84/02537 7/1984 PCT Int'l Appl. .

*Primary Examiner*—Donald R. Valentine

[57] ABSTRACT

The present invention relates to an electrolyzer comprising at least an intermediate electrodic structure interposed between two electrodic end-structures, a separate on each side of the intermediate electrodic structure, device for impressing electrolysis current to the electrolyzer and means for feeding electrolytes to and withdrawing electrolysis products from the electrolyzer compartments. The intermediate electrodic structure comprises a current conducting and distributing core (1) of at least one highly conductive metal sheet; a series of substantially parallel, projecting ribs (2, 10) provided or not onto both surfaces of said core (1); a liner (3) on each side of the core (1) and made of a corrosion resistant metal. These liners (3) are formed by cold- or hot-pressing to fit to the ribs (2, 10) in case core ribs are provided, or have parallel ribs (10') fixed thereto in case core (1) has no ribs. The liners (3) have peripheral projecting flanges (4) parallel to the liners.

24 Claims, 5 Drawing Sheets

MONOPOLAR AND BIPOLAR ELECTROLYZER AND ELECTRODIC STRUCTURES THEREOF

TECHNICAL FIELD

The present invention concerns monopolar and bipolar diaphragm or membrane electrolyzers, particularly electrolyzers comprising a multiplicity of electrolytic cells and more particularly the electrodic and current distributing structures thereof and electrodic structures thereof.

PRIOR ART

As it is well-known to the expert of the art, electrolyzers provided with separators (porous diaphragms or ion exchange membranes) positioned between the anodic and cathodic compartments comprise a series of intermediate electrodic structures electrically connected and positioned between two electrodic end structures. Each cell of the electrolyzer is delimited by walls, acting as current distributors and means for supporting the electrodes. The electrodes usually consist of expanded sheets, or perforated sheets or foraminous sheets, made of suitable materials, such as, for example, titanium for the anode and nickel or steel for the cathode.

Each intermediate electrodic structure is constituted by one of said walls and the relevant electrodes.

The electrodic structures are assembled in the so-called filter-press arrangement, being pressed together by suitable devices, e.g. tie-rods, jacks. Electrical connection is provided either in series or in parallel, taking into account the specific requirements and practical and economical considerations.

In the case the connection is in series, the electric current applied to the electrode end-structures gives rise to a bipolarity between the current distributing surfaces belonging to the same electrodic structure and therefore the electrode supported by one face is the anode of one cell whereas the electrode supported by the opposite face is the cathode of the adjacent cell.

In the case of parallel connection, current is fed by means of a series of electrical contacts connecting the busbars and each of the walls. Therefore, current flows longitudinally through the walls and then is fed to the electrodes by the supporting elements. When parallel connection is resorted to, the two electrodes supported by the same current conducting wall separating two adjacent cells have the same polarity (monopolar electrolyzers). In order to keep the current distribution in this type of electrolyzers as uniform as possible, it is necessary to minimize the ohmic drops inside the current distributing walls. As it is known, uneven current distribution causes an increased power consumption and shorter operating lifetime of the electrodes and membranes.

The larger the electrolyzers and thus the current distributing walls are, the more difficult results providing for an even current distribution: a material with a good electrical conductivity would be highly preferred for the construction of the current conducting walls. Most unfortunately, metals exhibiting a good electrical conductivity often do not resist under the corrosive electrolyzer environment. Therefore, metals are utilized which are substantially less conductive but are capable of undergoing the electrolyzer environment: for example, titanium is resorted to for the anodic structures and nickel for the cathodic ones. As a consequence, that fraction of the current distributing wall, which is more distant from the electrical connection to the bus-bar, is usually fed with substantially less current than the closer one.

A further problem occurs with the process for fabricating such electrolyzers, which involves several weldings of the electrodes to the supporting means, which are in turn welded to the current distributing walls.

U.S. Pat. No. 4,464,242 reduces this complexity of fabrication by obtaining the supporting means for the electrodes on both sides of a metal sheet through a stamping process. This metal sheet, which also acts as a current distributing wall, has to be made of a material resistant to corrosion and therefore, for the above reasons, the necessity of keeping the disuniformity of current distribution within certain limits leads to severe restrictions as regards the stamped sheet dimensions.

U.S. Pat. No. 4,488,946 describes an electrodic structure comprising a current conducting and distributing means provided with stud or bosses on both sides, which is made of a cheap material (steel, cast-iron or the like) having low conductivity. To make up for the ohmic losses, the structure has a remarkable thickness and is obtained by casting. The case element, of cast iron, steel or the like, has then to be covered by liners of corrosion resistant metals, suitably formed and attached by electric welding to the stud or bosses.

An electrodic structure is thus provided which substantially allows for an even current distribution and, like U.S. Pat. No. 4,464,242, involves an acceptable number of weldings; however, each single electrodic structure is very heavy, as a large thickness is required in order to minimize the ohmic losses, and further the casting process is certainly not so readily carried out and economic as a simple pressing or stamping process.

The present invention allows to obtain a filter-press electrolyzer, even of large dimensions, which provides for a uniform current distribution, has a light weight and is fabricated by a simple and economic process.

More particularly, the electrolyzer according to the present invention comprises two electrodic end-structures, at least an intermediate electrodic structure interposed between the electrodic end-structures, a separator (porous diaphragm or ion exchange membrane) on each side of intermediate electrodic structure to divide the electrolyzer into anode and cathode compartments, means for impressing electrolysis current to the electrolyzer and means for feeding electrolytes to and withdrawing electrolysis products from the electrolyzer compartments, the electrolyzer's the intermediate electrodic structure comprises:

(a) a current and distributing core consisting of at least one sheet of a highly conducting metal;

(b) a series of substantially parallel, projecting ribs provided or not onto both surfaces of the core, which ribs are obtained by cold- or hot-pressing the core sheet or sheets or by applying electroconducting elements, mechanically and electrically connected to the core.

(c) a pair of cold- or hot-pressed liners, one at each side of the core, made of a corrosion resistant metal, these liners being formed as to fit to ribs in the case core ribs are provided, or being substantially planar, with parallel ribs applied thereto, in the case on core ribs are provided onto the core; said liners having peripheral projecting flanges, substantially parallel to the plane of the liners;

(d) substantially planar electrode screens electrically connected to said liners.

The core, ribs, liners and electrode screens are electrically connected to each other and a frame element is interposed between the peripheral flanges of each liner and the relevant peripheral area of the core.

The current distributing core may consist of one, two or more metal sheets made of a highly conductive metal (for example Al, Cu, or alloys thereof). Advantageously the current conducting and distributing core is constituted by three sheets, the two external sheets being of a highly conducting metal and the intermediate sheet being made of a metal having a higher elastic modulus than that of the other two sheets.

The core is covered by stamped or pressed liners made of a material capable of resisting the electrolyzer environment. Suitable materials for the cathodic side are iron, carbon steel, stainless steel, nickel and nickel alloys. At the anodic side, liners made of nickel are adequate in the presence of alkaline solutions, while in the case of more aggressive solutions, such as alkali metal halide solutions, it is mandatory to use valve metals, e.g. titanium, zirconium, tantalum.

The use of such a current distributing core allows to obtain an electrodic structure which is sufficiently light, remarkably reduces ohmic losses, also in case of large-size electrolyzers and can be fabricated in a simple and economical manner.

Furthermore, in the case also the peripheral frame is made of an electrically conductive material, it further contributes to obtaining an even current distribution by reducing to a half the longitudinal current path within the current conducting core. Besides, the frame offers the advantage of a more reliable peripheral sealing of the gaskets.

Mechanical and electrical connection among the various components of the electrodic structure according to the present invention may be realized according to conventional techniques, especially by spot-welding or continuous welding, this type of connection being the most preferred as it is simple and ready to be carried out.

The sizes of the various elements are not critical but will be determined as to allow for a sufficient stiffness of the structure and planarity of the electrodes.

In commercial electrolyzers, the current distributing core is preferably constituted by a sheet of copper or aluminum having a suitable thickness, while the corrosion resistant liners are obtained by cold- or hot-pressing a metal sheet made of titanium for the anodic compartment and of nickel for the cathodic compartment, or other suitable materials.

The ribs are substantially parallel and suitably, equally spaced apart, for example at a distance of 10–15 cm, and are longitudinally extending in substantially vertical direction. The ribs on one side of the current distributing core may be offset with respect to the ribs on the other side.

The ribs, in case they are not directly obtained by cold- or hot-pressing or forming of the core sheet, may be constituted, for instance, by cold-formed electroconducting metal sections, (for example copper sections in case of core ribs or titanium or nickel sections in case of liners ribs, having a thickness of 1.5–2 mm, which are then connected to the core or the liner by the above mentioned techniques.

Also the shape of the ribs is not at all critical: a suitable shape is for example the one having a substantially trapezoidal cross-section with the minor base, which is in contact with the electrode mesh, having for example a width of about 3–10 mm, while the height may be about 20–25 mm. In case the ribs consist of metal sections they have advantageously a substantially L-shaped, U-shaped or trapezoidal cross-section.

The electrode structure is a foraminous structure which is liquid and gas permeable. Normally, the electrode structure is constituted by at least a metal screen or an expanded metal sheet. As well known in the art, suitable materials for electrode structure are:

cathode: iron, carbon steel, stainless steel, nickel and nickel alloys;

anode: in case of alkaline solutions: nickel; in case of more aggressive solutions, such as alkali halides solution,: valve metals, e.g., titanium, zirconium, tantalum, covered by an electrocatalytic coating containing platinum group metals and/or compounds thereof, preferably oxides.

As aforesaid, the electrodic structure of the present invention may be used both in monopolar as well as in bipolar electrolyzers. In the case of monopolar electrolyzers, the liners and the relevant electrode meshes positioned on the opposite sides of the current distributing core are obviously made of the same material, and viceversa in the case of bipolar electrolyzers. In this latter case, for example, a liner and a mesh made of nickel or steel, either suitably activated or not, may be utilized on the cathode side and a titanium expanded sheet and a finer titanium mesh screen on the anode side, both the mesh and the sheet being either suitably activated or not.

According to the present invention in the case the ribs are not provided onto the core, the vertical ribs are applied to the liners are spaced from the liners peripheral flanges with an open portion provided at the ends of ribs, allowing for the electrolyte, which is upwardly lifted together with the evolved gas, to be at least partially recirculated downwardly along the paths formed by the ribs. The internal circulation of the electrolyte results thus activated.

The electrodic structure of the present invention may be further utilized in SPE electrolyzers, wherein the electrodes, in the form of a very fine powder, are bonded or embedded in the ion exchange membrane, which acts as electrolyte. In this case, current transmission between the electrode and the meshes connected to the ribs may be provided by suitable current conducting, resilient elements.

The electrolyzer of the present invention is adapted to perform industrial electrolysis, and particularly it is advantageous for producing hydrogen and oxygen by electrolysis of potash solution and for producing chlorine, hydrogen and caustic soda by electrolysis of sodium chloride solutions.

In the following description, reference is made to some preferred embodiments of the present invention. It has to be understood however that these embodiments are not intended to limit the invention thereto. The invention will now be described by reference to the following drawings.

BEST MODE FOR CARRYING OUT THE INVENTION

In the figures the same reference numbers designate the same elements or corresponding elements.

Figure 1:
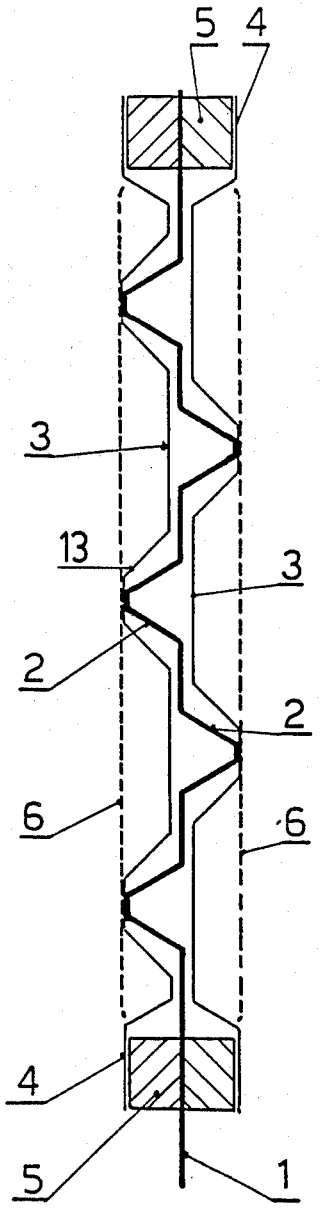
FIG. 1 shows a horizontal, cross-sectional view of a preferred embodiment wherein the ribs are obtained by cold-forming of the current conducting and distributing core, which consists of only one highly conductive metal sheet.

With reference to FIG. 1, the current conducting and distributing core 1 is suitably formed by cold- or hot-pressing, according to the type of metal and thickness of the sheet, obtaining ribs 2, which are off-set and opposed on the two sides. Two cold- or hot-pressed liners 3, made of the same materials or of different materials, respectively in the case of monopolar and bipolar electrolyzers, these materials being in any case resistant to the electrolyzer environment, are fixed, for example by welding, on the top of ribs 2 and, in correspondenee of their peripheral flanges 4, onto the metal elements in the form of frames 5.

The assembly formed by the two peripheral flanges 4 (which acts also as hydraulic sealing surfaces), the peripheral edges of current distributing core 1 and the two frames 5 interposed between the core 1 and the liners 3 respectively, perform the function of stiffening the electrodic structure. Frames 5 are made of an electrically conductive material and therefore they further improve current distribution over the current distribution core 1, as electric current is thus fed along all the core edges, substantially reducing the current path to a half.

Besides, a perfect peripheral sealing of the gasket is obtained, which results to be more effective than the sealing described in U.S. Pat. No. 4,464,242.

The electrode meshes 6 are attached onto ribs 13 and made of the same or of a different material, depending upon whether the electrolyzer is monopolar or bipolar.

Figure 2:
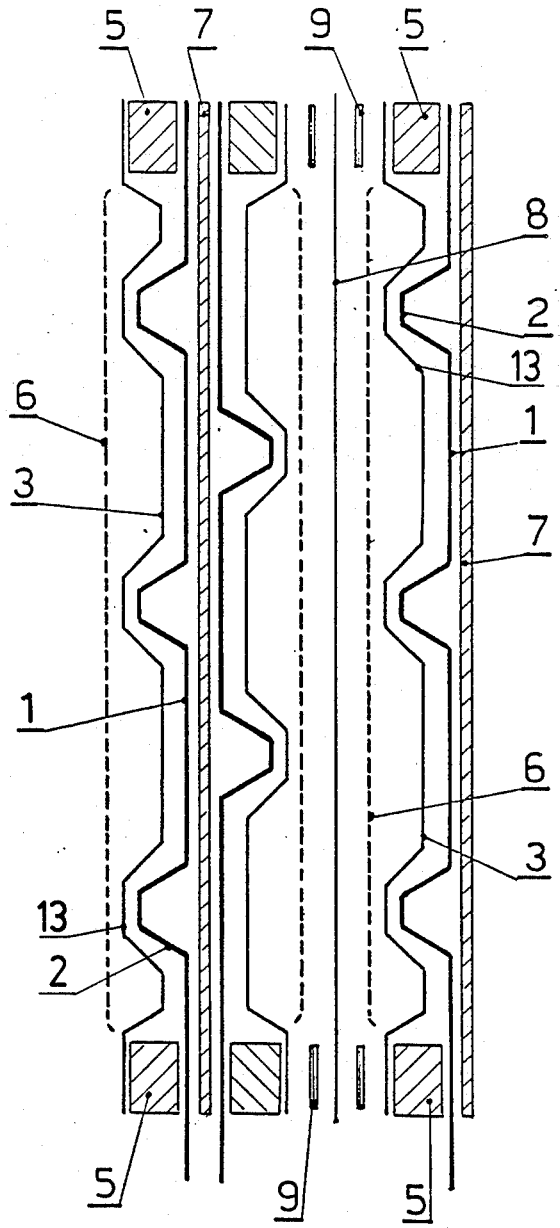
FIG. 2 is an exploded, horizontal, cross-sectional view of another embodiment of the present invention wherein the current distrubuting core is constituted by two cold-formed sheets of a highly conductive metal, attached to an intermediate sheet which performs the function of stiffening the structure; the core is then covered by suitably formed liners, made of a corrosion resistant, conducting material, the respective ribs being off-set.

FIG. 2 illustrates both an electrodic end-structure and an intermediate electrodic structure of an electrolyzer according to the present invention wherein the current conducting and distributing core is constituted by a sheet 7, substantially planar and rigid, and by thin, cold-formed sheets 1, attached to sheet 7 and made of a highly conductive material (Cu, Al or the like). The current conducting core is protected by liners 3 provided with peripheral flanges 4 fixed onto frames 5, as illustrated in FIG. 1.

Reference numeral 6 indicates the electrode meshes, while numeral 8 indicates the separator (ion exchange membrane or porous diaphragm) interposed between the anodic and cathodic compartments, provided with relevant gaskets 9.

Figure 3:
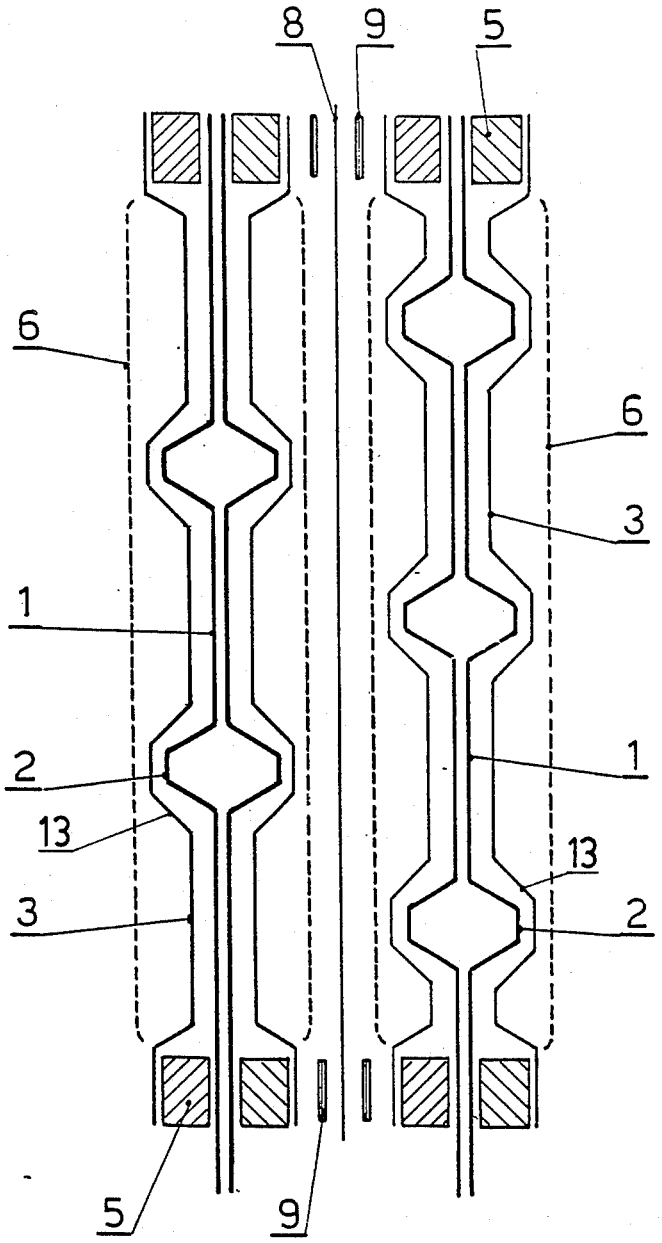
FIG. 3 shows an exploded, horizontal, cross-sectional view of a further embodiment wherein the ribs of each core sheet are opposed but coincident and the core is constituted by two sheets connected together.

FIG. 3 illustrates two typical electrodic intermediate structures of a further embodiment of the present invention. The current conducting and distributing core is constituted by two sheets 1 formed in such a way that when assembling the two sheets 1, the ribs 2 on the opposed sides result coincident. Between the two sheets 1 an intermediate planar sheet, as described in FIG. 2, may be positioned, which performs a stiffening function and is made of a metal having a higher elasticity modulus than that of the two sheets 1, although exhibiting a lower electrical conductivity (for example, carbon steel) or even an inert material (for example a plastic material). The other elements illustrated in FIG. 3 correspond to those of FIGS. 1 or 2.

Figure 4:
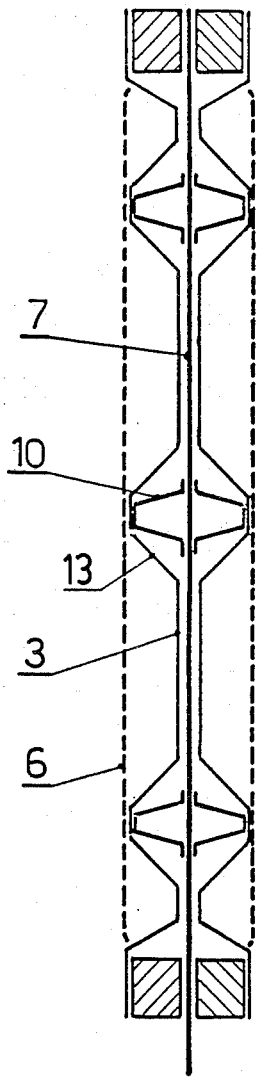
FIG. 4 shows another embodiment of the present invention wherein the ribs consist of cold-formed sections fixed onto the current distributing core.
Figure 4:
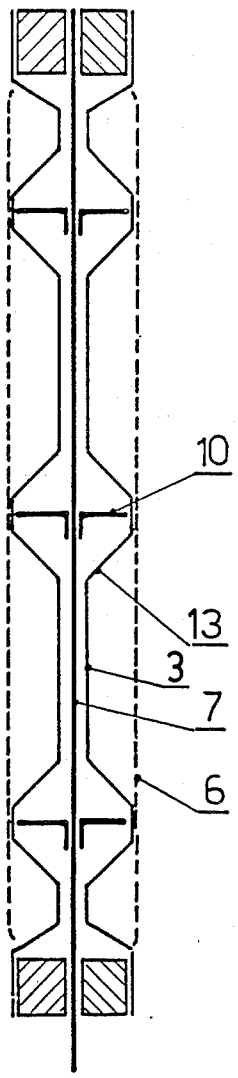

FIG. 4 illustrates a further embodiment of the present invention, wherein the ribs 10 are formed by cold-formed sections haviing an L-shaped (FIG. 4*b*) or trapezoidal cross-section (FIG. 4*a*), and electrically connected to the current conducting and distributing core 7 according to any known technique.

The shape of ribs 10, made of a material exhibiting a good electrical conductivity such as Al or Cu, obviously is not critical and may be different from those illustrated in the present application. Also the number of ribs is not critical: however they must be in a sufficient number as to offer suitable mechanical support for the electrodes, an even current distribution and an adequate stiffness of the assembly.

Figure 5:
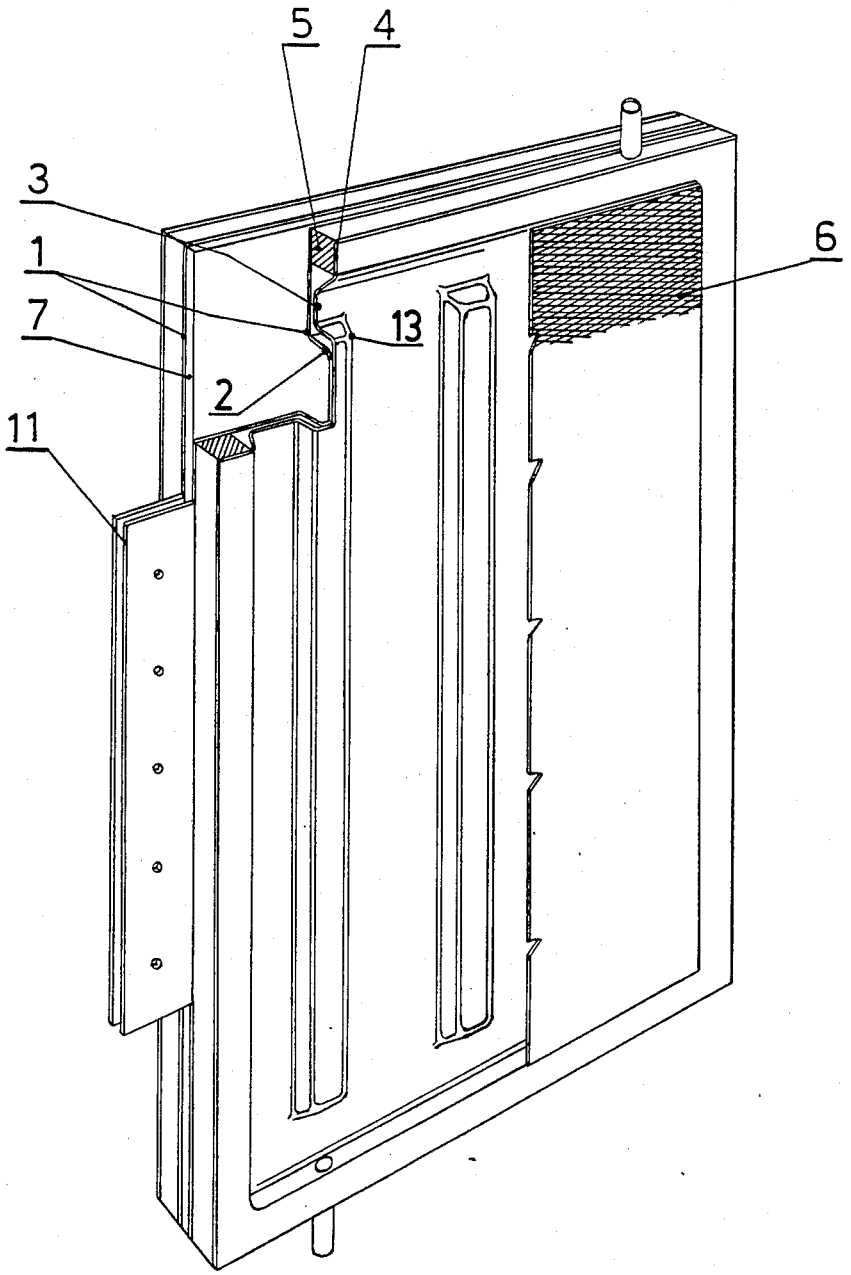
FIG. 5 is a partially exploded perspective view of an electrodic structure according to the present invention embodying the constructive elements of FIG. 2.

The intermediate electrodic structure of FIG. 2 is illustrated in a perspective view in FIG. 5 wherein the ribs 13 for supporting the electrode mesh 6 can be clearly seen. The ribs are substantially parallel and extending in a vertical direction. Electric current, fed by means of element 11 to the current conducting and distributing core 7 and to the conducting frame 5, having a large cross-section, is evenly distributed, without appreciable ohmic losses, to ribs 2 and ribs 13 and then to the electrode 6.

Figure 6B:
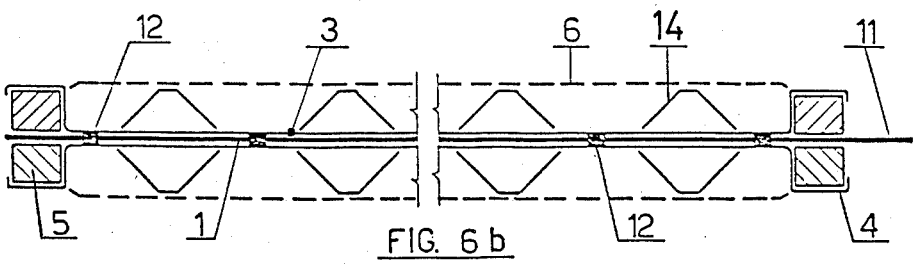
FIG. 6*a* and 6*b* respectively show a front view and a horizontal cross-sectional view of a further embodiment of the present invention wherein the projecting ribs are applied to the liners and an open portion is provided at the ends of the ribs to allow the electrolyte recirculation.
Figure 6A:
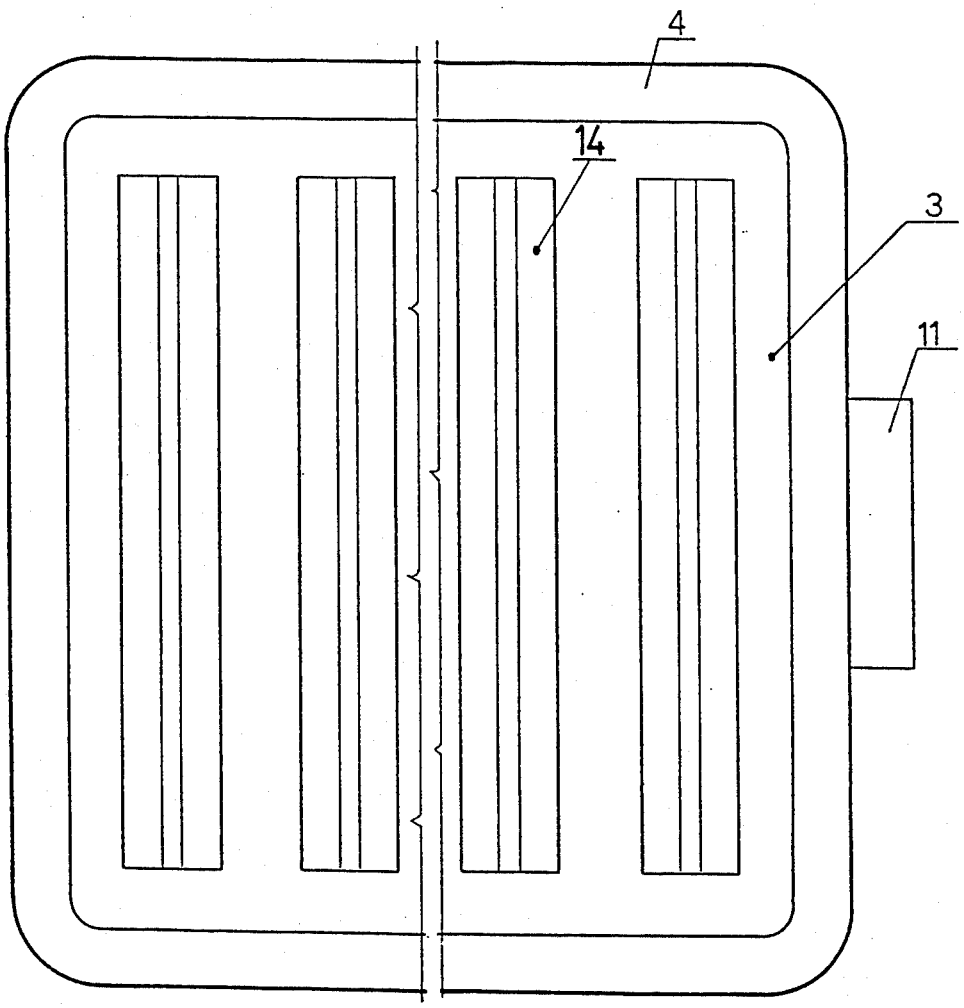

FIGS. 6*a* and 6*b* illustrate a further embodiment of the present invention wherein the current conducting and distributing core 1 is constituted by a single planar sheet, for example made of copper. The liners 3 are in the form of a tray, the edges thereof being provided with suitable flanges 4. Onto the bottom of liners 3, ribs 14, having a trapezoidal cross-section are applied. The ends of the ribs 14 are spaced apart from the flange 4 in order to leave an open end portion allowing for the electrolyte, which is upwardly lifted together with the evolved gas, to be downwardly recirculated through the paths, having a trapezoidal cross-section, formed by the inferior of the ribs 14. The internal recirculation of the electrolyte is thus improved.

In FIG. 6*b*, the electrical and mechanical connections between the core and the liners are schematically illustrated and indicated by reference numeral 12. These connections may be advantageously effected by spot-welding.

I claim:

1. An electrolyzer including two electrodic end-structures, at least an intermediate electrodic structure interposed between said electrodic end-structures, porous diaphragm or ion exchange membrane constituting a separator on each side of said intermediate electrodic structure to divide the electrolyzer into anode and cathode compartments, means for impressing electrolysis current to the electrolyzer and means for feeding electrolytes to, and withdrawing electrolysis products from the electrolyzer compartments, said intermediate electrodic structure comprising:

(a) a current conducting and distributing core (1) including at least one thin sheet of highly conducting metal provided with a plurality of substantially parallel, outwardly projecting ribs forming together with said core a substantially channel-like structure;

(b) a pair of liners (3), one at each side of said core, made of a corrosion resistant metal, said liners being provided with a plurality of corresponding outwardly projecting ribs (13, 14) dimensioned to fit over said core ribs (2, 10), and having peripheral projecting flanges (4);

(c) substantially planar electrode screens (6) electrically connected to said liners (3);

said core (1), said core ribs (2, 10), said liners (3), said liner ribs (13, 14), and said electrode screens (6) electrically connected to each other; and a frame element (5) interposed between the peripheral flanges (4) of each liner (3) and the peripheral area of the core (1).

2. The electrolyzer according to claim 1, wherein said core ribs (2, 10) are integrated with said core and formed by cold or hot pressing of said core sheet.

3. The electrolyzer according to claim 1, wherein said corresponding liner ribs (13, 14) are formed by cold or hot pressing of said liner.

4. The electrolyzer according to claim 1, wherein said core ribs (2, 10) are formed by applying electroconductive sections, mechanically and electrically connected to said core.

5. The electrolyzer according to claim 1, wherein nsaid liner ribs (13, 14) are obtained by applying electroconductive sections, mechanically and electrically connected to said liners, said ribs having open ends spaced apart from said flanges (4).

6. The electrolyzer of claim 1, wherein said ribs (2, 10, 13, and 14) are disposed at substantially equal intervals and longitudinally extend substantially in the verical direction.

7. The electrolyzer of claim 1, wherein said ribs (2, 10, 13, and 14) have a substantially trapezoidal cross-section.

8. The electrolyzers of claim 1, wherein said current conducting and distributing core (1) is constituted by three sheets, the two external sheets being made of a highly conducting metal and the intermediate sheet having higher rigidity that the total rigidity provided by the other two sheets.

9. The electrolyzer of claim 1 wherein said liners (3) are attached to said current conducting and distributing core (1) by spot-welding.

10. The electrolyzer of claim 1 wherein said liners (3) on both sides of said current conducting and distributing core (1) are made of the same material when utilized in monopolar electrolyzers.

11. The electrolyzer of claim 1 wherein said liners (3) on both sides of the current conducting and distributing core (1) are made of a different material when utilized in bipolar electrolyzers.

12. The electrolyzer of claim 1 wherein said liners (3) in contact with the catholyte are made of nickel or stainless steel, and said liners (3) in contact with the anolyte are made of titanium.

13. The electrolyzer of claim 1 wherein said elements in the form of frame (5) interposed between said peripheral flanges (4) of said liners (3) and the peripheral area of said current conducting and distributing core are made of a conducting material.

14. An electrolyzer comprising two electrodic end-structures, at least an intermediate electrodic structure interposed between said electrodic end-structures, porous diaphragm or ion exchange membrane constituting a separator on each side of said intermediate electrodic structure to divide the electrolyzer into anode and cathode compartments, means for impressing electrolysis current to the electrolyzer and means for feeding electrolytes to and withdrawing electrolysis products from the electrolyzer compartments, said intermediate electrodic structure comprising:

(a) a current conducting and distributing core (1) including at least one substantially planar sheet of highly conductive metal;

(b) a pair of liners (3), one at each side of the core, made of a corrosion resistant metal, said liners being provided with outwardly projecting ribs (13, 14), said ribs forming vertically extending channels between interior walls of said ribs and exterior walls of said liners, said liners having peripheral projecting flanges (4);

(c) substantially planar electrode screens (6) electrically connected to said liners (3);

said core (1), said liners (3), said liner ribs (13, 14), and said electrode screens (6) electrically connected to each other; and a frame element (5) interposed between the peripheral flanges (4) of each liner (3) and the peripheral area of the core (1).

15. The electrolyzer of claim 14, wherein said liner ribs (13) are formed integrally with said liner by cold or hot pressing the liner.

16. The electrolyzer of claim 14, wherein said liner ribs (14) are formed by applying electroconductive sections made of corrosion resistant material, mechanically and electrically connected to the liners, said ribs having open ends spaced apart from the flanges (4).

17. The electrolyzer of claim 14, wherein said ribs (2, 10, 13, and 14) are disposed at substantially equal intervals and longitudinally extend substantially in the vertical direction.

18. The electrolyzer of claim 14, wherein said ribs (2, 10, 13, and 14) have a substantially trapezoidal cross-section.

19. The electrolyzers of claim 14, wherein said current conducting and distributing core (1) is constituted by three sheets, the two external sheets being of a highly conducting metal and the intermediate sheet having higher rigidity that the total rigidity provided by the other two sheets.

20. The electrolyzer of claim 14 wherein said liners (3) are attached to said current conducting and distributing core (1) by spot-welding.

21. The electrolyzer of claim 14 wherein said liners (3) on both sides of the current conducting and distributing core (1) are made of the same material when utilized in monopolar electrolyzers.

22. The electrolyzer of claim 14 wherein said liners (3) on both sides of the current conducting and distributing core (1) are made of a different material when utilized in bipolar electrolyzers.

23. The electrolyzer of claim 14 wherein said liners (3) in contact with the catholyte are made of nickel or stainless steel, and said liners (3) in contact with the anolyte are made of titanium.

24. The electrolyzer of claim 14 wherein said elements in the form of frame (5) interposed between said peripheral flanges (4) of said liners (3) and the peripheral area of said current conducting and distributing core are made of a conducting material.

* * * * *